US009095828B2

(12) United States Patent
Mennenga et al.

(10) Patent No.: US 9,095,828 B2
(45) Date of Patent: Aug. 4, 2015

(54) CONTAINER HAVING FLEXIBLE WALLS WITH CONNECTING PIECE FOR MIXER SHAFT AND COUPLING PIECE FOR DRIVE DEVICE FIXED MAGNETICALLY TO OPPOSITE INNER AND OUTER SURFACES OF CONTAINER WALL

(75) Inventors: Heyo Mennenga, Rostock (DE); Oscar-Werner Reif, Hanover (DE); Gerhard Greller, Göttingen (DE); Reinhard Baumfalk, Göttingen (DE)

(73) Assignee: Sartorius Stedim Biotech GmbH (DE)

( * ) Notice: Subject to any disclaimer, the term of this patent is extended or adjusted under 35 U.S.C. 154(b) by 751 days.

(21) Appl. No.: 11/717,357

(22) Filed: Mar. 13, 2007

(65) Prior Publication Data

US 2007/0253288 A1 Nov. 1, 2007

(30) Foreign Application Priority Data

Apr. 28, 2006 (DE) ..... 10 2006 020 461

(51) Int. Cl.
*B01F 13/08* (2006.01)
*B01F 11/00* (2006.01)
*B01F 15/00* (2006.01)

(52) U.S. Cl.
CPC ..... *B01F 13/0827* (2013.01); *B01F 11/0082* (2013.01); *B01F 11/0091* (2013.01); *B01F 15/0085* (2013.01); *B01F 2215/0032* (2013.01)

(58) Field of Classification Search
CPC ..... B01F 11/0082; B01F 11/0091; B01F 15/0085; B01F 13/0827; B01F 2215/0032
USPC ..... 366/257, 298, 273–274, 314, 348, 349, 366/331, 117, 118, 315–317, 332–335; 6/257, 298; 604/416, 903; 215/DIG. 3, 215/DIG. 8; 206/219–221, 818; 416/3; 383/127; 435/302.1
See application file for complete search history.

(56) References Cited

U.S. PATENT DOCUMENTS

| | | | | |
|---|---|---|---|---|
| 2,543,818 | A * | 3/1951 | Wilcox | 366/118 |
| 2,615,692 | A * | 10/1952 | Müller | 366/273 |
| 2,793,166 | A | 5/1957 | Hatch | |
| 3,563,515 | A * | 2/1971 | Chapman et al. | 366/298 |
| 4,983,045 | A * | 1/1991 | Taniguchi | 366/117 |
| 6,491,422 | B1 | 12/2002 | Rütten et al. | |
| 7,278,780 | B2 * | 10/2007 | Goodwin et al. | 366/273 |
| 7,832,922 | B2 * | 11/2010 | Schoeb | 366/273 |
| 8,342,737 | B2 * | 1/2013 | Greller et al. | 366/169.1 |
| 8,366,311 | B2 * | 2/2013 | Vanhamel et al. | 366/102 |

(Continued)

FOREIGN PATENT DOCUMENTS

| | | | |
|---|---|---|---|
| DE | 10 2004 013 078 | A1 | 10/2005 |
| WO | WO 03/028869 | A2 | 4/2003 |
| WO | 2013/031608 | * | 10/2013 |

*Primary Examiner* — Charles Cooley
(74) *Attorney, Agent, or Firm* — Gerald E. Hespos; Michael J. Porco; Matthew T. Hespos

(57) ABSTRACT

A container has flexible walls defining an interior. A mixer is arranged in the interior of the container and includes a mixer shaft with opposite first and second ends. A mixing element is mounted to the first end of the mixer shaft. The second end of the mixer shaft is fixed magnetically to a coupling piece disposed on the exterior of the flexible wall of the container. The coupling piece is connected operatively to a force introducing device that generates movement of the mixer.

15 Claims, 6 Drawing Sheets

(56) References Cited

U.S. PATENT DOCUMENTS

| | | | | |
|---|---|---|---|---|
| 8,690,129 | B2 * | 4/2014 | Ludwig et al. | 261/84 |
| 8,690,418 | B2 * | 4/2014 | Ludwig et al. | 366/102 |
| 8,794,821 | B2 * | 8/2014 | Watkins et al. | 366/276 |
| 8,870,443 | B2 * | 10/2014 | Greller et al. | 366/102 |
| 2004/0047232 | A1 * | 3/2004 | Terentiev | 366/273 |
| 2005/0206260 | A1 * | 9/2005 | Akiyama | 310/104 |
| 2005/0249033 | A1 * | 11/2005 | Krause | 366/332 |
| 2007/0253287 | A1 * | 11/2007 | Myhrberg et al. | 366/273 |
| 2007/0253288 | A1 * | 11/2007 | Mennenga et al. | 366/274 |
| 2009/0275121 | A1 * | 11/2009 | Greller et al. | 435/295.1 |
| 2009/0314666 | A1 * | 12/2009 | Reif et al. | 206/221 |
| 2010/0015696 | A1 * | 1/2010 | Claes et al. | 435/303.3 |
| 2011/0013473 | A1 * | 1/2011 | Ludwig et al. | 366/101 |
| 2011/0013474 | A1 * | 1/2011 | Ludwig et al. | 366/102 |
| 2011/0038222 | A1 * | 2/2011 | Ludwig et al. | 366/102 |
| 2011/0044567 | A1 * | 2/2011 | Barbaroux et al. | 383/120 |
| 2011/0058448 | A1 * | 3/2011 | Reif et al. | 366/250 |
| 2011/0158037 | A1 * | 6/2011 | Bernard et al. | 366/173.2 |
| 2012/0003733 | A1 * | 1/2012 | Gueneron | 435/289.1 |
| 2012/0027324 | A1 * | 2/2012 | Morrissey et al. | 383/105 |
| 2012/0155216 | A1 * | 6/2012 | Morrissey et al. | 366/273 |

* cited by examiner

CONTAINER HAVING FLEXIBLE WALLS WITH CONNECTING PIECE FOR MIXER SHAFT AND COUPLING PIECE FOR DRIVE DEVICE FIXED MAGNETICALLY TO OPPOSITE INNER AND OUTER SURFACES OF CONTAINER WALL

BACKGROUND OF THE INVENTION

1. Field of the Invention

The invention relates to a container having flexible walls, in the interior of which container there is arranged a mixer which has a mixing element arranged at a first end of a mixer shaft, it being possible for the mixer shaft with the mixing element to be set moving longitudinally by a drive arranged outside the interior of the container.

2. Description of the Related Art

Containers having flexible walls are increasingly used in particular as flexible disposable containers in pharmacology and biotechnology for liquids in production processes.

DE 10 2004 013 078 A1 discloses a container having flexible walls which is formed as a flexible disposable container and has a mixing device for liquids located in flexible disposable containers. In this case, a mixing element formed as a mixing plate is arranged in the interior of the container at one end of a mixer shaft, which is led through the container wall and, outside the interior of the container, is set moving longitudinally by a drive of a vibration mixer.

The disadvantage with this vibration mixer, which, in principle, has been tried and tested, is that the mixer shaft has to be led through the wall of the container in a sealed manner. To this end, a fixed, sealed connection must be produced between container wall and mixer shaft. This is relatively complicated and costly and can constitute a weak point during use. In addition, specific welding apparatuses and molds have to be created, which make fabrication more expensive.

Furthermore, US Publication 2005/024933 A1 discloses a similar mixing device. Here, too, the mixer shaft is led through the container wall of a flexible disposable container. The mixer shaft is then set moving longitudinally, electrically or pneumatically, by a drive arranged outside the interior of the container.

This container therefore has the same disadvantages as outlined above.

Furthermore, U.S. Pat. No. 6,491,422 B1 discloses a vibration mixer which likewise has a mixer plate whose mixer shaft has to be led through a container wall to a drive arranged outside the container. Here, too, there is the problem of sealing in the container wall.

Furthermore, WO 03/028869 A2 discloses a container or a bag which, in the interior of its container, has a mixer or stirrer rotating about an axis.

The disadvantage with this stirrer is that it is relatively complicated and is anchored to the container wall. Such known stirrers based on the principle of a magnetic stirrer additionally have the problem that they are relatively restricted in terms of the rotational speed and the volume to be mixed. Attempts are therefore being made to change to more economical and more effective vibration mixers having longitudinal oscillations.

It is therefore an object of the present invention to provide a simple and economical effective mixer which does not have a sealing problem.

SUMMARY OF THE INVENTION

In conjunction with a container having flexible walls with a mixer inside the container, the above-mentioned object is achieved in that the mixer shaft can be placed on the inside of a container wall with its second end facing away from the mixing element and can be fixed magnetically on the outside of the container wall, facing away from the inside, by means of a coupling piece, and in that the coupling piece is operatively connected to a force introducing device belonging to the drive.

The fact that the mixer shaft can be placed with its second end on the inside of a container wall and is fixed magnetically from the outside by a coupling piece means that an aperture in the container wall can be dispensed with, so that no sealing problems arise. The mixer, comprising mixer shaft and mixing element, merely has to be introduced into the interior of the container during the production of the latter. A complicated connection to the container wall can be omitted, since the fixing is carried out from the outside by means of the coupling piece. If required, a fixing to the inner wall can additionally be provided by adhesive bonding. The drive of the mixer is carried out via the external coupling piece, which is operatively connected to a force introducing device belonging to the drive. This produces a simple, reliable, effective and economical mixing apparatus which does not have known sealing problems.

According to a preferred embodiment of the invention, the second end of the mixing shaft has a connecting piece with a connecting surface which rests on the inside of the container wall. The coupling piece can have a contact surface which rests on the outside of the container wall so as to correspond to the connecting surface of the connecting piece. Here, the mixing shaft can have a relatively small cross section, since the fixing is carried out via the connecting piece, which has a large area relative to the mixing shaft, and via the corresponding coupling piece.

According to a further preferred embodiment of the invention, the connecting piece and the coupling piece can be fixed in relation to each other by permanent magnets. In this case, for example, the connecting piece of the mixer can be made of a ferromagnetic material, while the coupling piece has at least one permanent magnet. However, connecting piece and coupling piece can also have oppositely polarized permanent magnets. The container wall which, in the case of a disposable bag, amounts to only a few tenths of a millimeter, determines the distance between connecting piece and coupling piece, so that high forces can be transmitted by modern permanent magnets. However, it is also possible to provide the external coupling piece with an electromagnetic field.

According to a further preferred embodiment of the invention, the connecting piece and the coupling piece are at least partly formed in the shape of a plate. The result is a relatively large-area connecting surface of the connecting piece and a correspondingly large contact surface of the coupling piece.

According to a preferred embodiment of the invention, the coupling piece has at least one attachment, on which the force introducing device of the drive acts. In the case of only one attachment, this is arranged centrally in relation to the coupling piece and to the shaft axis of the mixer.

According to a further preferred embodiment of the invention, the coupling piece has a plurality of attachments, to which a plurality of force introducing devices can apply longitudinal movements at different times. As a result, it is possible, for example, to act on the mixing element with a tumbling movement in addition to a reciprocating movement. It is also possible to act on the mixing element with a rotational component. Therefore, additional vortices can be introduced into the movement of the liquid to be mixed in the bag, which considerably improves the mixing effect. In the case of a multiphase action on the mixer via a plurality of attachments, bending points, which absorb the small tilting angles that arise, can be provided in the drive or in the mixer. In this case, however, an elastic shaft can also be sufficient.

According to a further preferred embodiment of the invention, the force introducing element acts on the mixer shaft, the coupling piece or its attachment pneumatically or via compressed air pulses. It is also possible to act on the coupling piece or its attachment via a mechanical pressure plunger. In both cases, it is necessary to produce only an upward movement, since the return is provided via the inherent weight of the mixer or container. The inherent weight forms the return force as a result of gravitation.

According to a further preferred embodiment of the invention, the force introducing device is connected mechanically or electromagnetically to the coupling piece on which it acts.

According to a preferred embodiment of the invention, the plurality of force introducing devices is each assigned to a separate drive or a common drive. However, it is also possible to assign these to a common drive.

According to a further preferred embodiment of the invention, the mixer has two mixing elements arranged at a distance from each other. If necessary, however, the arrangement of three or more mixing elements is possible.

According to further preferred embodiment of the intervention, the mixing elements are formed as mixer plates provided with conical holes. In this case, the conical holes in a plurality of mixer plates can be oriented in relation to one another or else opposite each another.

According to a further preferred embodiment of the invention, at least two mixers are arranged in the interior of the container, it being possible for the mixers to be driven with different phases in order to produce a directed flow. In this case, the mixers can be arranged opposite each other or at an angle to each other, for example a right angle.

DETAILED DESCRIPTION OF THE PREFERRED EMBODIMENTS

Figure 1:
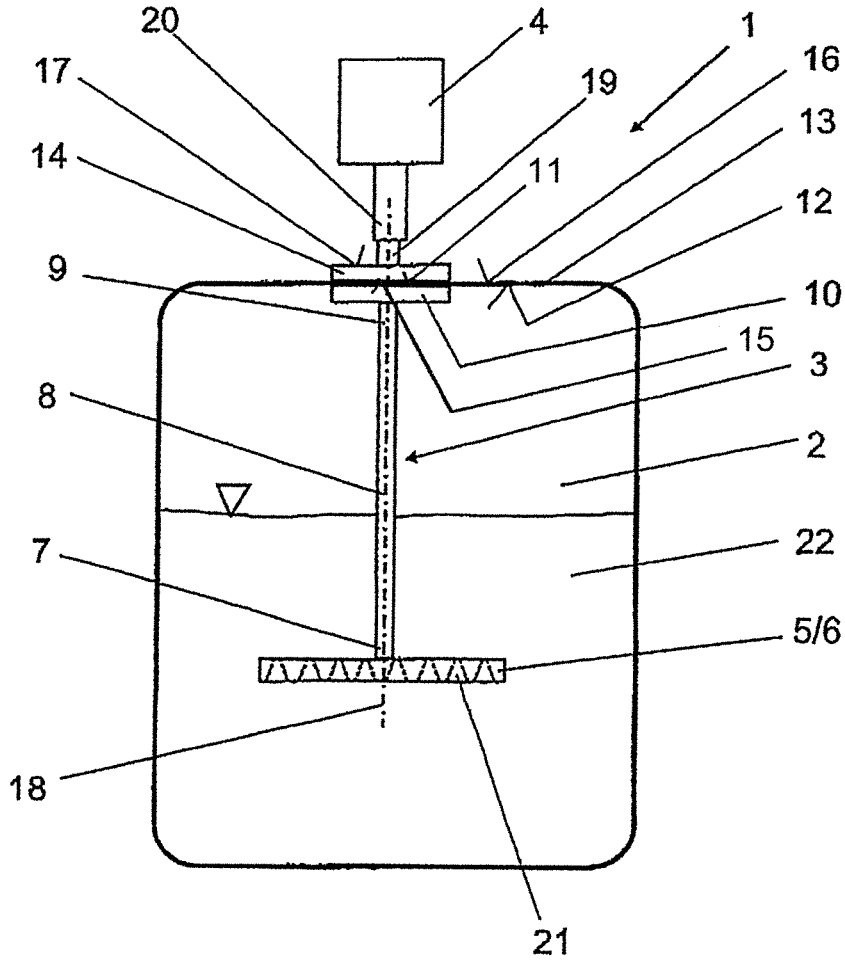
FIG. 1 shows a schematic side view of a container having flexible walls, mixer and drive.

Turning to FIG. 1, a container 1 having flexible walls substantially comprises a container interior 2 with a mixer 3 which is driven by a drive 4.

The mixer 3 comprises a mixing element 5, which is formed as a mixer plate 6. The mixer plate 6 is arranged concentrically at a first end 7 of a mixer shaft 8. At the second end 9 of the mixer shaft 8, facing away from the first end 7, a connecting piece 10 is arranged concentrically. The connecting piece 10 can be placed on an inside 12 of the container wall 13 with its connecting surface 11 facing away from the mixing element 5.

A coupling piece 14 can be placed with its contact surface 15 against the outside 16 of the container wall, facing away from the inside 12, so as to correspond to the connecting surface 11. By means of a permanent magnet (not illustrated) in the coupling piece 14, the mixer 3 is fixed to the container wall 13 via its connecting piece 10.

On its end face 17 facing away from the contact surface 15, the coupling piece 14 has an attachment 19 arranged centrally in relation to the shaft longitudinal axis 18. The attachment 19 can be connected mechanically to a force introducing device 20 of the drive 4 in a manner corresponding to FIG. 1.

By the force introducing device 20, the coupling piece 14 and therefore, via the connecting piece 10 and the mixer shaft 8, the mixing element 5 can be set moving longitudinally. With its conical holes 21, the mixer plate 6 forms a vibration mixer, which thoroughly mixes the liquid medium 22 arranged in the interior 2 of the container.

Figure 2:
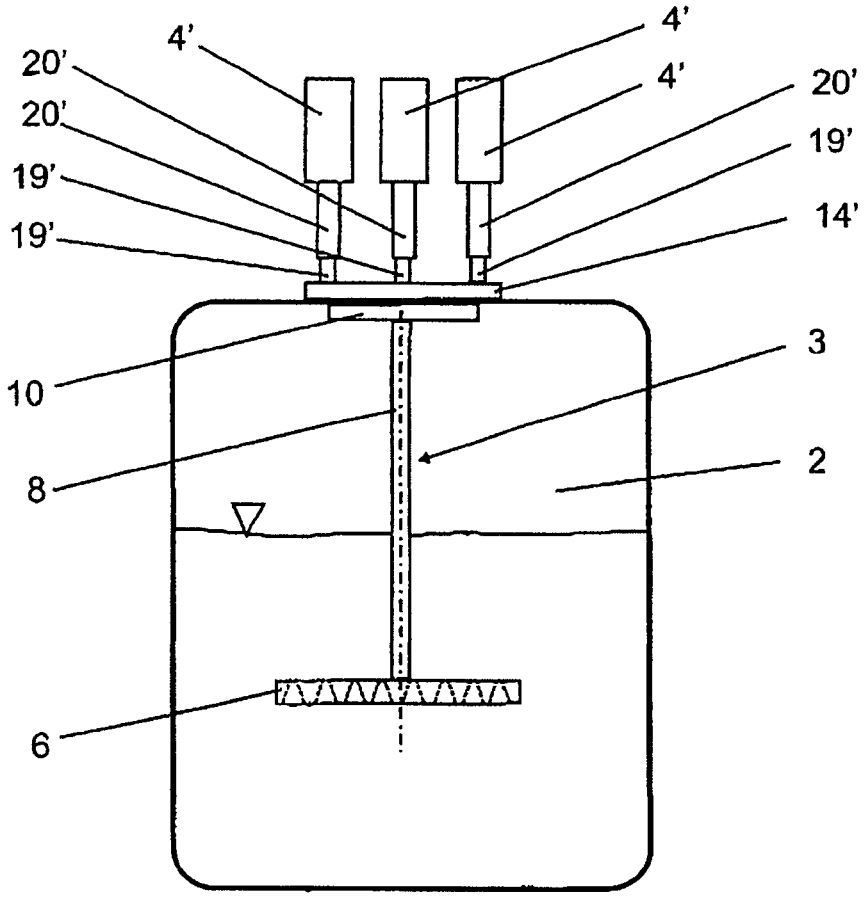
FIG. 2 shows a side view of a further container having flexible walls with a plurality of force introducing devices and a plurality of drives.
Figure 3:
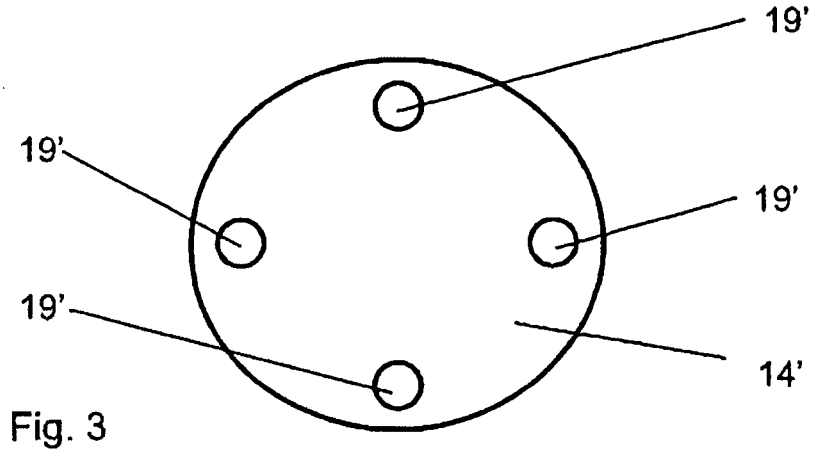
FIG. 3 shows a plan view of the coupling piece from FIG. 2 in an enlarged illustration.
Figure 8:
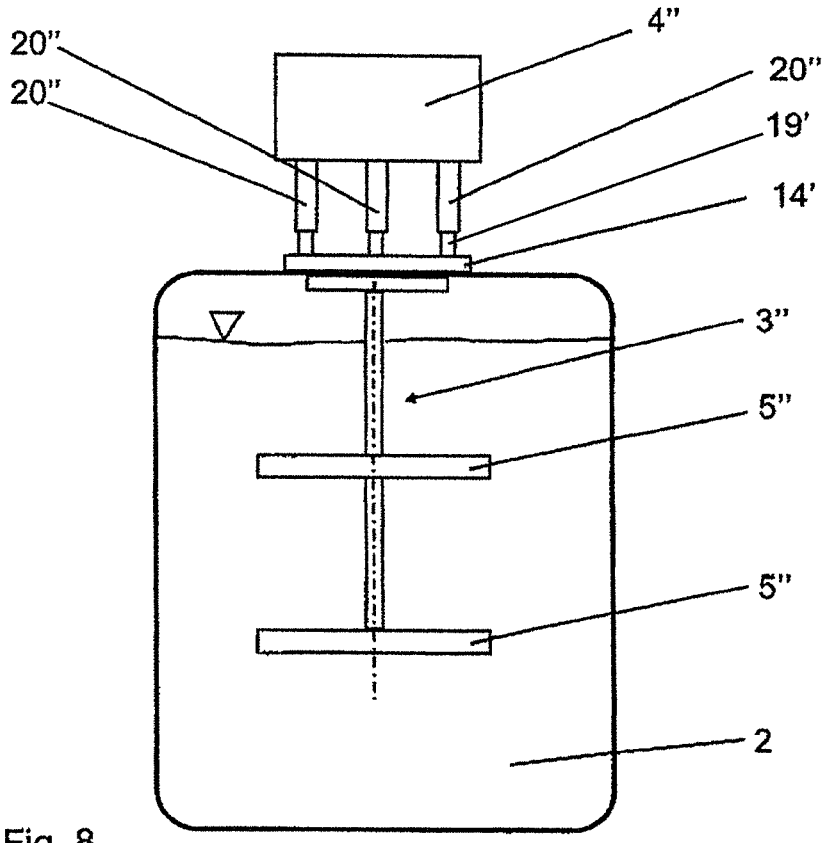
FIG. 8 shows a further container having a drive and a plurality of force introducing devices and a mixer having two mixing elements.
Figure 9:
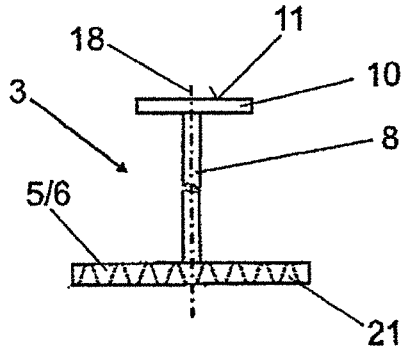
FIG. 9 shows a side view of the mixer from FIG. 1.
Figure 10:
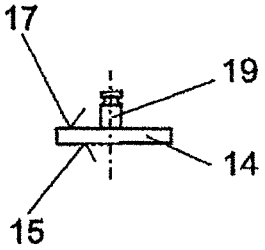
FIG. 10 shows a side view of the coupling piece from FIG. 2.

According to an exemplary embodiment corresponding to FIGS. 2 and 3, the coupling piece 14' has four attachments 19', on which four force introducing devices 20' which are driven by four drives 4' act. In accordance with the exemplary embodiment according to FIG. 8, however, it is also possible to drive the force introducing devices 20" by means of a single common drive 4". According to the exemplary embodiment of FIG. 8, the mixer 3" can also have two or more mixing elements 5".

Figure 4:
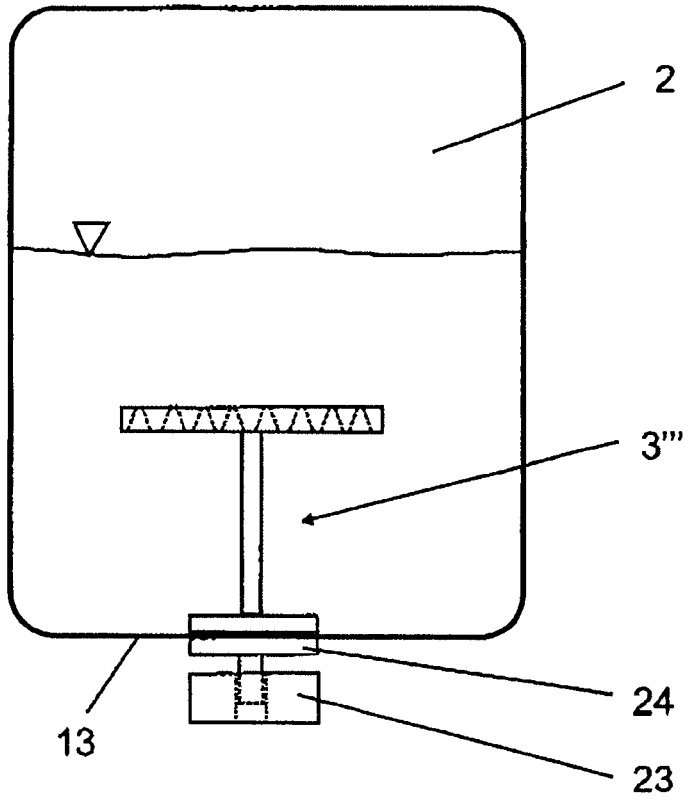
FIG. 4 shows a side view of a further container having flexible walls and electromagnetic force introducing device.
Figure 5:
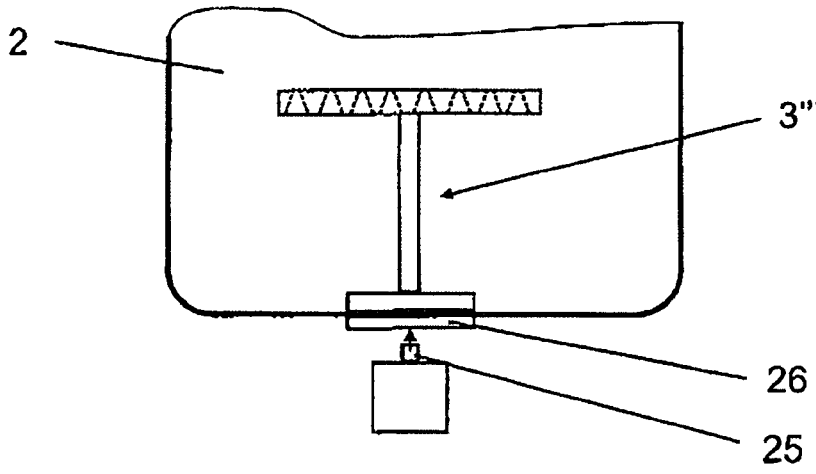
FIG. 5 shows a further container having flexible walls and pneumatic force introducing device in outline.

According to the exemplary embodiments of FIGS. 4 and 5, the mixer 3''' is arranged in the vertical direction at the bottom on the container wall 13.

Figure 6:
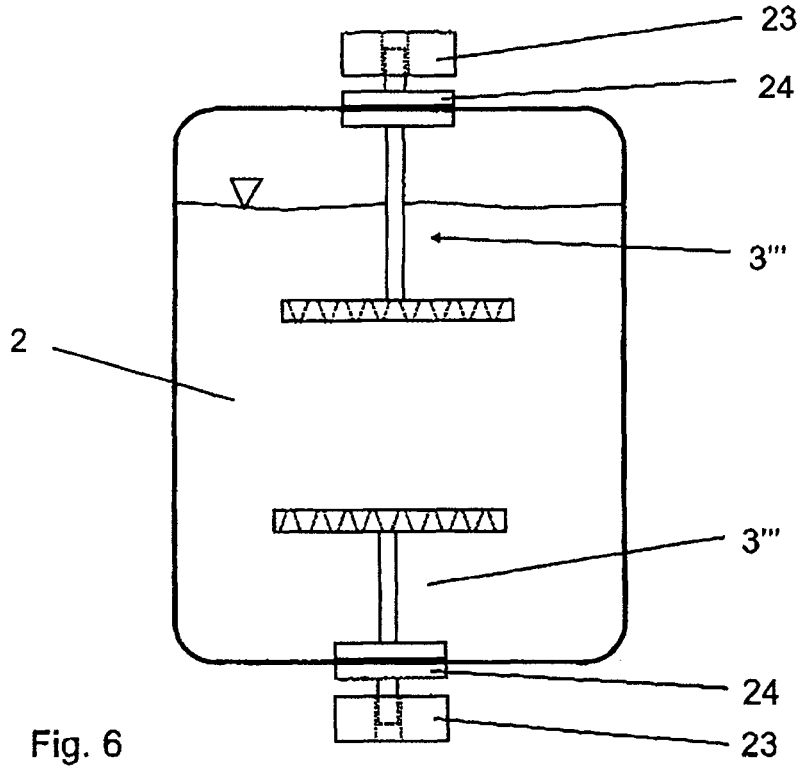
FIG. 6 shows a further container having flexible walls with two mixers opposite each other.
Figure 7:
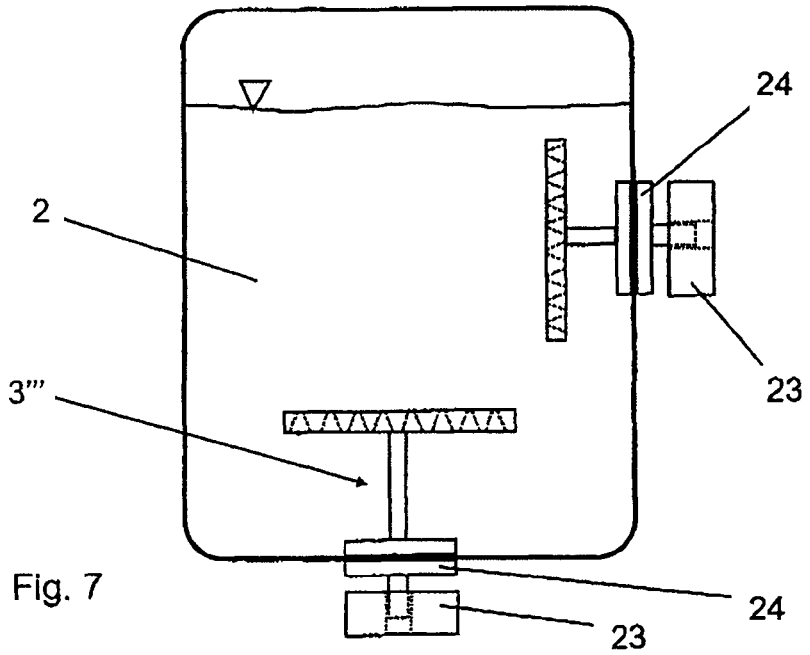
FIG. 7 shows a further container having flexible walls with two mixers arranged at right angles to each other.

According to the exemplary embodiments of FIGS. 4, 6 and 7, in each case an electromagnetic force introducing device 23 acts on the coupling pieces 24.

Figure 11:
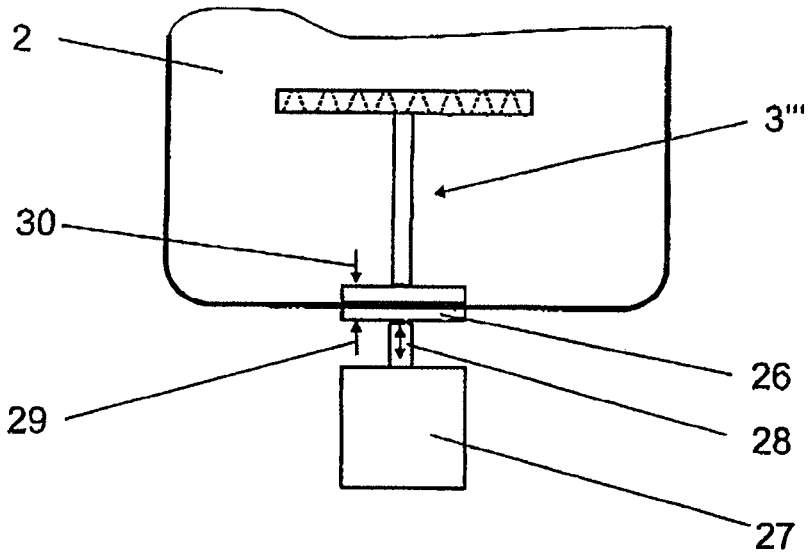
FIG. 11 shows a further container having flexible walls and mechanical force introducing device via a pressure plunger.

According to the exemplary embodiment of FIG. 5, a pneumatic force introducing device 25 acts on the coupling piece 26 with compressed air pulses. Instead of the pneumatic force introducing device 25, a mechanical force introducing device 27 having an oscillating pressure plunger 28 (see FIG. 11) can also be used. The pressure plunger 28 executes an up and down movement 29, 30, raising the mixer 3''' in the upward movement 29 via the coupling piece 26 which, during the downward movement 30, follows the pressure plunger 28 with the mixer 3''' as a result of gravity.

In the interior 2 of the container, according to the exemplary embodiment of FIG. 6, there are two mixers 3''' arranged opposite each other while, according to the exemplary embodiment of FIG. 7, two mixers 3''' arranged at right angles in relation to each other are arranged in the interior 2 of the container.

When delivered, the mixer 3 is already located in the container 1. In order to produce the operating state, the connecting piece 10 is merely held on the container wall 13 and fixed from outside with the coupling piece 14. The connecting piece 10 and the coupling piece 14 attract each other, so that further connecting elements are not necessary. For the purpose of simpler handling, the connecting piece 10 of the mixer 3 can also be fixed to the bag wall from the inside, for example with a spot of adhesive. However, the container can also already be supplied with a coupling piece 14 placed on the outside. The mixers 3, 3" and 3'" are controlled via the drives 4, 4', 4" by control devices (not illustrated).

What is claimed is:

1. A container (1) comprising:

at least one flexible container wall (13) having opposite inner and outer surfaces (12, 16) extending continuously along the flexible container wall (13) and being free of apertures through the flexible container wall (13), the inner surface (12) of the flexible container wall (13) defining part of an interior (2) of the container (1);

a connecting piece (10) fixed on the inner surface (12) of the flexible container wall (13) and a coupling piece (14, 14', 24, 26) fixed on the outer surface (16) of the flexible container wall (13) so that the flexible container wall (13) extends continuously between the connecting piece (10) and the coupling piece (14, 14', 24, 26) with the connecting piece (10) being entirely in the interior (2) of the container (1) and the coupling piece (14, 14', 24, 26) being entirely outside the container (1), at least one of the connecting piece (10) and the coupling piece (14, 14', 24, 26) comprising a permanent magnet and the other of the connecting piece (10) and the coupling piece (14, 14', 24, 26) being formed from a material that is attracted to the permanent magnet so that the connecting piece (10) and the coupling piece (14, 14', 24, 26) are fixed to the respective inner and outer surfaces (12, 16) of the flexible container wall (13) and in opposed relationship to one another by magnetic forces between the connecting piece (10) and the coupling piece (14, 14', 24, 26);

a mixer shaft (8) disposed entirely within the interior (2) of the container (1) and having opposite first and second ends (7, 9) spaced apart along a longitudinal axis (18), a mixer element (5) arranged at the first end (7) of the mixer shaft (8) and the second end (9) of the mixer shaft (8) being fixed at the connecting piece (10); and at least one drive (4, 4', 4") disposed entirely outside the container (1) and including at least one force introducing device (20, 20', 20", 23, 25) operatively connected to the coupling piece (14, 14', 24, 26), the drive (4, 4', 4") generating reciprocating longitudinal movement of the coupling piece (14, 14' 24, 26), the connecting piece (10), the flexible container wall (13), the mixer shaft (8) and the mixer element (5) in directions substantially along the longitudinal axis (18).

2. The container according to claim 1, wherein the connecting piece (10) has a connecting surface (11) which rests on the inner surface (12) of the container wall (13).

3. The container according to claim 2, wherein the coupling piece (14, 14', 24, 26) has a contact surface (15) which rests on the outer surface (16) of the container wall (13) so as to correspond to the connecting surface (11) of the connecting piece (10).

4. The container according to claim 3, wherein the connecting piece (10) and the coupling piece (14, 14' 24, 26) are oppositely polarized permanent magnets.

5. The container according to claim 4, wherein the connecting piece (10) and the coupling piece (14, 14', 24, 26) are at least partly formed in the shape of plates.

6. The container according to claim 3, wherein the coupling piece (14, 14', 24) has at least one attachment (19, 19'), on which the force introducing device (20, 20', 20", 23) acts.

7. The container according to claim 3, wherein the coupling piece (14') has a plurality of attachments (19'), to which a plurality of force introducing devices (20, 20') can apply longitudinal movements at different times.

8. The container according to claim 7, wherein the different times at which the force introducing devices act on the plurality of attachments is selected to act on the mixing element (5) with a tumbling movement in addition to a reciprocating movement.

9. The according to claim 7, wherein at least one of the force introducing devices is operative to act on the mixing element (5) with a rotational component.

10. The container according to claim 7, wherein the plurality of force introducing devices (20, 20') each belong to a separate drive (4') or a common drive (4").

11. The container according to claim 1, wherein the force introducing device (25) acts on the coupling piece (26) pneumatically.

12. The container according to claim 1, wherein the force introducing device (20, 20', 20", 23) acts mechanically or electromagnetically on the coupling piece (14, 14', 24).

13. The container according to claim 1, wherein the mixer (3") has two mixing elements (5") arranged at a distance from each other.

14. The container according to claim 1, wherein the mixing elements (5) are formed as mixer plates (6) provided with conical holes (21).

15. The container according to claim 1, wherein at least two mixers (3") are arranged in the interior (2) of the container and in that the mixers (3, 3") can be driven with different phases in order to produce a directed flow.

* * * * *